United States Patent [19]

Boyle

[11] 4,331,231

[45] May 25, 1982

[54] DISPLAY TRAY WITH TILT PLATFORM

[75] Inventor: Daniel J. Boyle, Hartland, Wis.

[73] Assignee: Champion International Corporation, Stamford, Conn.

[21] Appl. No.: 189,098

[22] Filed: Sep. 22, 1980

[51] Int. Cl.[3] ..... B65D 5/52

[52] U.S. Cl. ..... 206/45.25; 229/41 B

[58] Field of Search ..... 206/45.25, 45.24, 45.18, 206/45.19, 491; 229/16 R, 41 B

[56] References Cited

U.S. PATENT DOCUMENTS

| | | | |
|---|---|---|---|
| 2,146,420 | 2/1939 | Davidson | 206/45.25 X |
| 2,200,818 | 5/1940 | Bergstein | 206/45.25 |
| 2,652,969 | 9/1953 | Pfaff | 229/41 B X |
| 2,783,013 | 2/1957 | Williamson | 206/45.25 X |
| 3,353,658 | 11/1967 | Ettin | 206/45.25 |
| 4,049,114 | 9/1977 | Danheisser | 206/45.25 X |

*Primary Examiner*—Steven M. Pollard

*Attorney, Agent, or Firm*—Evelyn M. Sommer

[57] ABSTRACT

A one-piece collapsible or knockdown tray for displaying cylindrical articles is provided with an integral platform connected to a bottom edge of the rear wall of the tray for supporting the tray at an inclined angle to a horizontal supporting surface, so that the cylindrical articles housed within the tray can be readily viewed.

8 Claims, 11 Drawing Figures

DISPLAY TRAY WITH TILT PLATFORM

BACKGROUND OF THE INVENTION

This invention relates to a display tray provided with an integral support platform along one edge thereof to support the tray at an inclined angle to a horizontal support surface.

It is difficult to display and dispense cylindrical articles, such as pencils, pens, cigars, and the like, from a horizontally disposed, or planar tray. The tray should be inclined at an angle to the horizontal support surface so that the cylindrical articles can be readily viewed by a prospective purchaser and upon removal of any one or more of the articles, the cylindrical articles can roll towards the forward end of the tray wherein they can be readily grasped and removed by insertion of the fingers in the rear of the tray.

It would also be advantageous if such a tray could be shipped in collapsed or knockdown position to minimize the need of storage space and to reduce shipping costs until the tray is ready for use. At that point, it should be readily erectable with a minimum of effort.

This invention relates to such a tray.

SUMMARY OF THE INVENTION

The tray of the present invention is provided with an integral platform connected to one bottom edge of the rear or back wall of the tray for supporting the tray at an inclined angle to a horizontal supporting surface.

The front and back wall panels of the tray are also provided with side flaps having tabs which are inserted in notches in the bottom wall of the tray to maintain the tray in an erect, rectangular configuration. Upon removal of the tabs from the notches in the bottom wall, the sidewalls of the tray may be pivoted inwardly over the bottom wall. The front and back walls of the tray are connected by diagonal score lines to the sidewalls so that upon pivoting of the sidewalls over the bottom wall of the tray, the front and back walls will also pivot and collapse over the bottom wall and opposed sidewalls of the tray to form a substantially knockdown package. The platform secured to an edge of the back wall of the tray may then be pivoted 180 degrees to lie beneath the bottom wall wherein the package can be shipped to a user who will simply erect the package by reversing the steps and inserting the tabs on the side flaps into the notches in the bottom wall of the tray.

The integral platform is provided with a base and a pair of lateral support arms or wings positioned beneath the bottom wall to support the erected tray at an inclined angle so that the cylindrical articles housed within the tray can be viewed and upon removal of any number thereof from the tray, the remainder will roll towards the front of the tray so that they can be readily removed by insertion of the fingers in the rear of the tray behind the articles.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
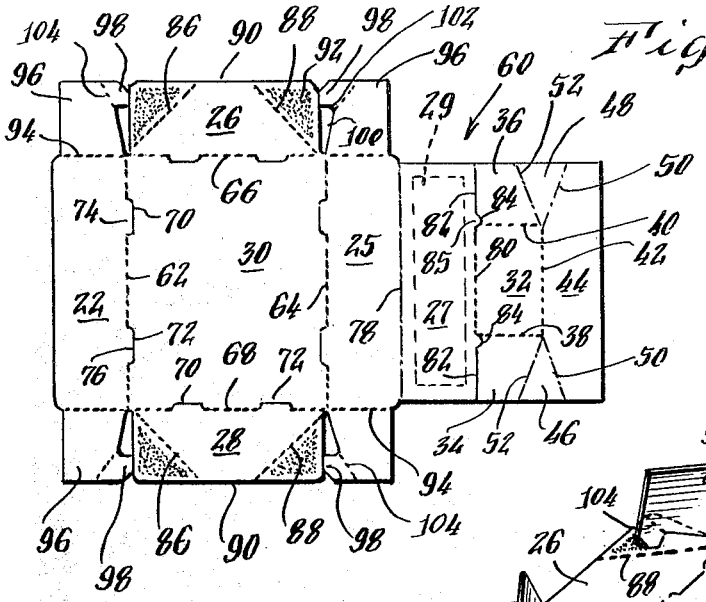
FIG. 1 is a plan view of a blank for forming the display tray of the present invention.

Referring now to the drawings in detail, wherein like numerals indicate like elements throughout the several views, the present invention comprises a substantially rectangular display tray 20 supported by an upright platform 22' at an inclined angle to a horizontal support surface 24.

Tray 20 includes a front wall 22, a rear wall or back wall 24 connected by a pair of opposed sidewalls 26 and 28. Tray 20 also includes a bottom wall 30 connected along opposed fold lines to each of the front and back walls 22, 25 and each of the sidewalls 26, 28.

Platform 22' includes an upright standard 32 provided with a pair of lateral wings or lateral support arms 34 and 36 foldably connected to opposed side edges 38 and 40 of standard 32. Standard 32 is foldably connected by a score line 42 to an elongated base 44 seated on horizontal support surface 24 to support the upright standard 22 and tray 20 at an inclined angle to the horizontal support surface 24. Infolded triangular panels 46 and 48 connect each of the lateral support wings 34,36 to base 44. Triangular panels 46 and 48 are connected by score line pairs 50 and 52, respectively, between the base 44 and each of the lateral wings 34, 36.

Figure 10:
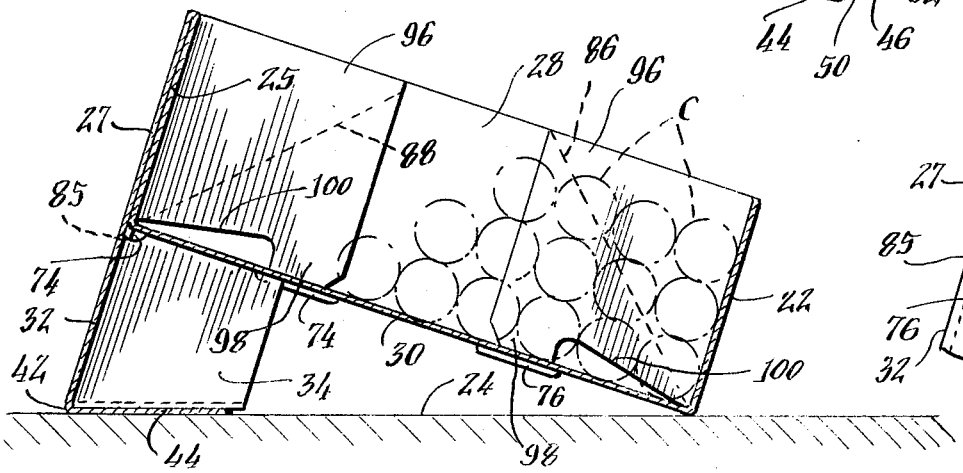
FIG. 10 is a cross-sectional view taken substantially along the plane indicated by line 10—10 of FIG. 9.

Tray 20 is adapted to support a plurality of cylindrical articles C, as illustrated in phantom lines in FIG. 10. The cylindrical articles C are placed within tray 20 between the walls 22, 25, 26, and 28 on bottom support wall 30. Because of platform 22' supporting tray 20 at an angle to the horizontal surface 24, cylindrical articles C can be readily viewed by a prospective purchaser. Additionally, as the articles are removed one at a time from the interior of tray 20, the remainder of the cylindrical articles C will roll forwardly until they abut front wall 22. This will not only continue to aid in displaying the cylindrical articles C to a prospective purchaser, but will aid in the removal and dispensing of the cylindrical articles as the fingers need only be inserted in the rear of tray 20 between the articles and rear wall 25 to grasp one of the articles and remove it from the tray 20.

Tray 20 with the integral tilt platform 22' is formed from a unitary, paperboard blank 60 illustrated in FIG. 1.

Blank 60 includes bottom wall panel 30 foldably connected along score lines 62 and 64 to the front and rear wall panels 22 and 25, respectively. Similarly, the bottom wall panel 30 is connected along opposed score lines 66 and 68 to rectangular sidewall panels 26 and 28, respectively. A pair of notches 70 and 72 are cut along each of the score lines 62, 64, 66 and 68 so that when the front and rear panels 22, 25 and sidewall panels 26, 28 are folded relative to bottom wall 30, a pair of downwardly extending tongues 74 and 76 are produced along each of the score lines 62, 64, 66 and 68.

Foldably connected along a score line 78 to the opposed edge of rear panel 25 is a similar rectangular panel 27. Connected by a score line 80 to the opposed edge of panel 27 is the upright standard panel 32. Connected by score lines 38, 40 respectively, to opposed edges of upright standard panel 32 are the lateral wing panels 34 and 36, respectively. The inner edge 82 of each wing panel is cut along a line 82 until it meets the score line 80. A tab 85 or notch 84 connects the cut line 82 to the score line 80. The opposite side of rectangular panel 27 is provided with a glue area indicated by the numeral 29.

A diagonal score line 86 and 88 extends from the opposed innermost corners of each of the sidewall panels 26, 28 to the free edge 90 thereof and intersects the free edge 90 at a distance approximately equal to one-third of the distance between the ends of the free edge 90. The area 92 between each of the diagonal score lines 86, 88 and the adjacent corner of free edge 90 of each of the side panels 26, 28 is provided with glue for a purpose to be described hereinafter.

Connected by a score line 94 to each side edge of the front and rear wall panels 22, 25, respectively, is a panel extension 96 provided with a downwardly extending tab 98 formed by cutting the inner edge of each of the panel extensions 96 along a diagonal line 100 and a horizontal line 102 contiguous thereto.

Figure 5:
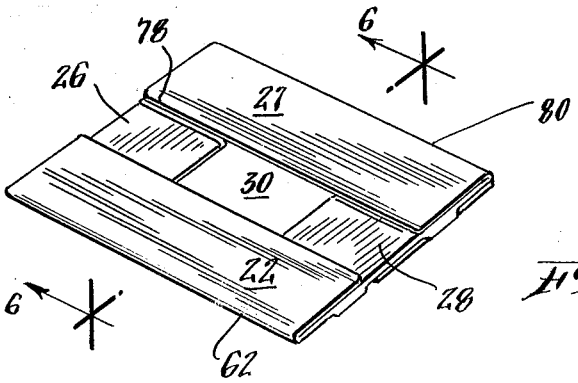
Figure 6:
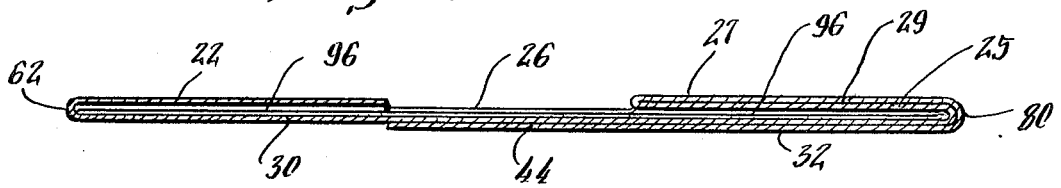
FIG. 6 is a cross-sectional view taken substantially along the plane indicated by line 6—6 of FIG. 5.
Figure 7:
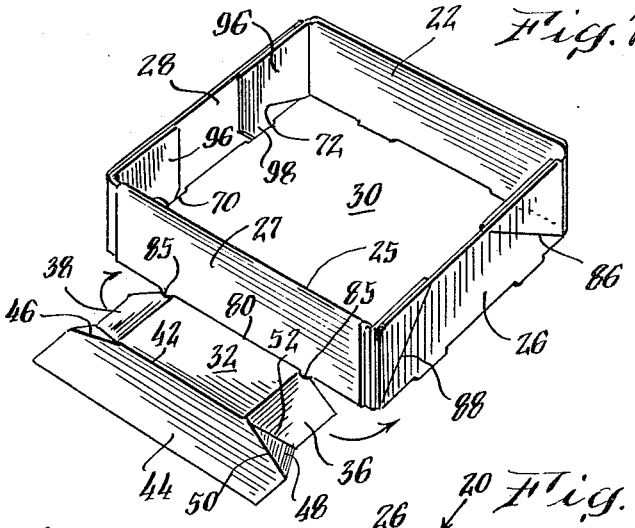
Figure 8:
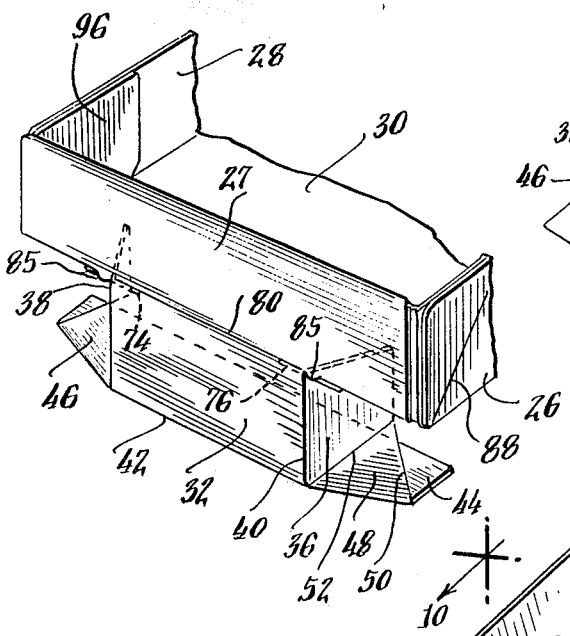
Figure 9:
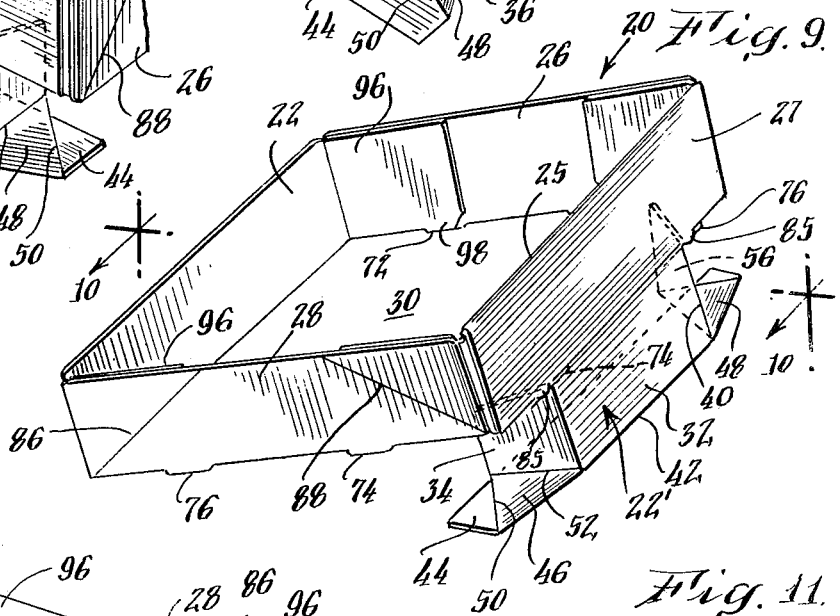
FIG. 9 is a perspective view of the erected tray with an integral tilt platform of the present invention.

FIGS. 2 to 6, inclusive, illustrate the folding of blank 60 into a knocked-down or collapsable tray 20 and platform 22', while FIGS. 7 and 8 illustrate the manner of erecting the tray 20 and platform 22' from the collapsed or knockdown state.

Figure 2:
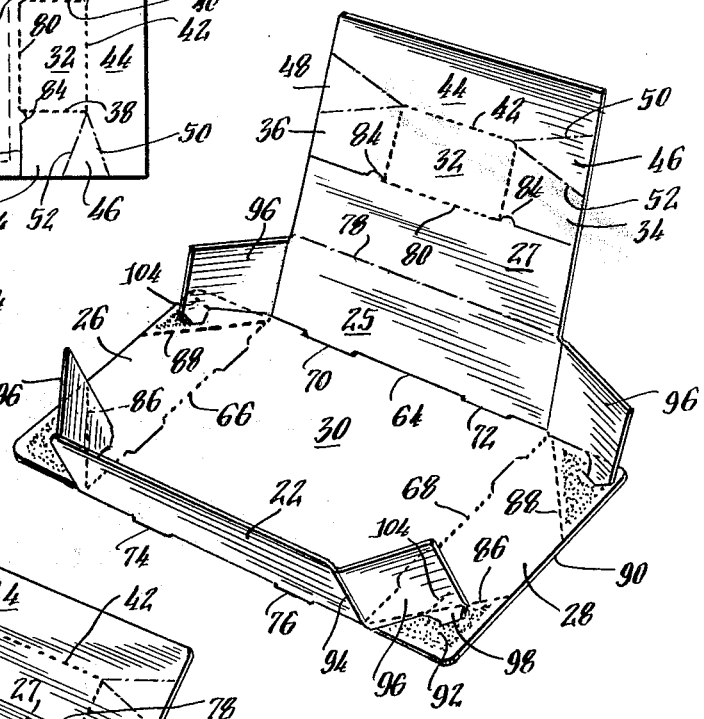
FIGS. 2 through 5, 7 and 8, are perspective views illustrating the folding of the blank of FIG. 1 to form the tray of the present invention.

In order to form the tray 20, the front and rear wall panels 22 and 25 are folded 90 degrees about score line 62 and 64, respectively, as illustrated in FIG. 2. Similarly, sidewall panels 26 and 28 are folded about score lines 66 and 68, so they assume a 90 degree orientation relative to bottom wall 30. Lateral panel extensions 96 are also folded 90 degrees inwardly about their respective score lines 94 attaching them to the front and rear panels 22 and 25, respectively, and are adhesively connected to each of the glue areas 92 on the side panels 26 and 28, respectively. The downwardly extending tabs 98 are aligned with notches 70 and 72 so they can be inserted therethrough, if desired. However, the end portions of each of the lateral panel extensions 96 are not adhesively connected to the side panels 26 and 28, respectively, at the glue areas 92 so that the tabs 98 can be bent 180 degrees about itself along a score line 104, if desired, to be positioned between the lateral panel extension 96 and its adjacent respective sidewall panel 26 or 28.

Figure 3:
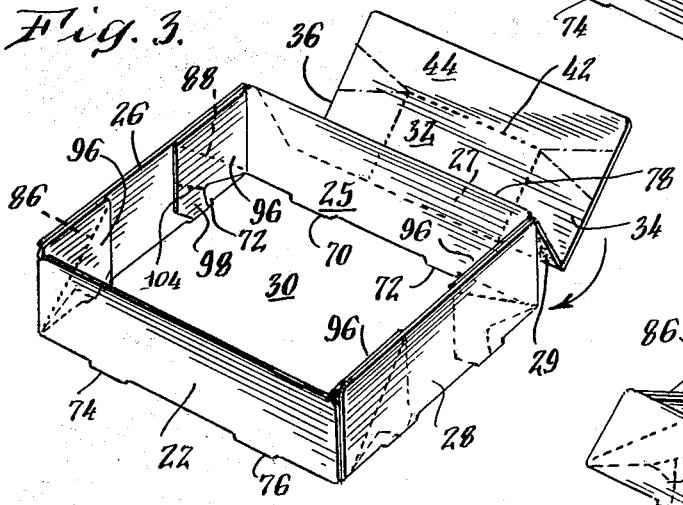

As illustrated in FIG. 3, the rectangular panel 27 can then be folded 180 degrees about score line 78 so as to overly the rear surface of back panel 25. Glue area 29 can then contact the rear side of back panel 25 to adhesively secure rectangular panel 27 thereto to form a double walled back panel for tray 20. Basically, the tray 20 is now in a rectangular parallelopiped configuration, without a cover or top and with a tail element consisting of the upright standard panel 32 and base panel 44, which are pivotably connected to panel 27 along score line 80. Since panel 27 forms a portion of the back wall of the tray, the platform 22' having elements 32 and base 44 is integrally connected to the tray 20.

Figure 4:
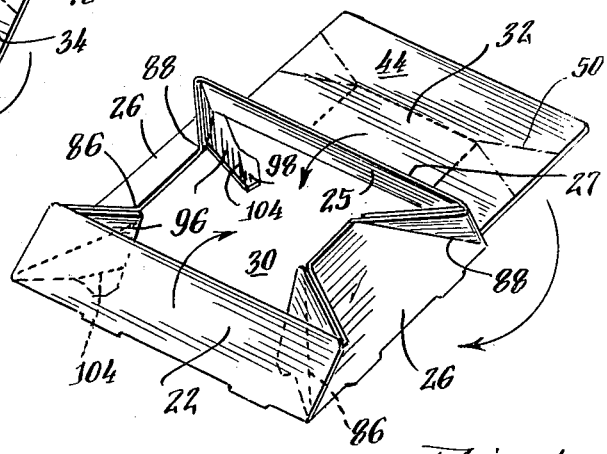

As illustrated in FIGS. 4, 5 and 6, the tray can be collapsed and knocked down to a substantially planar or flat condition for shipment or storage by merely pivoting the side panels 26 and 28 downwardly about score lines 66 and 68, respectively, so they overly bottom wall 30. This will cause diagonal score lines 86, 88 on each sidewall 26, 28 to move inwardly (FIG. 4) causing the lateral panel extensions 96 to pivot about its respective score line 94 connecting it to either the front panel 22 or rear panel 25 so as to overly that portion of the sidewall 26, 28 which is bent back upon itself about the diagonal score line 86, 88 or the glue area 92. Front and rear wall panels 22 and 25, respectively, are also pulled downwardly about score lines 62 and 64, respectively, to overly bottom wall 30 and the lateral panel extensions 96 (FIG. 5). The platform portion 22' consisting of standard 32, base 44, and lateral support wings 34, 36 can all be pivoted about score line 80 to lie beneath bottom wall 30 as illustrated in FIG. 6, forming a collapsed, unitary package for shipment or storage.

In order to erect the tray 20 and platform 22, it is only necessary to pull sidewalls 26, 28, front wall 22 and rear wall 25 with glued rectangular panel 27 to an upright condition relative to the bottom wall 30 about the respective score lines connecting the panels thereto. Tabs 98 are then unfolded about score lines 104 and inserted downwardly through an adjacent notch 70, 72. This maintains the sidewalls 26, 28 as well as the front and rear walls 22, 25, 27 locked relative to bottom wall 30.

Standard 32 of platform 22' is then folded about score line 80 so that it assumes a substantially upright position as illustrated in FIG. 8. The triangular panels 46 and 48 are then bent inwardly about score lines 52 and 50 and base 44 positioned in a horizontal plane on support surface 24 by bending it 90 degrees about score line 42 relative to upright standard 32. Standard 32 will support tray 20 at an inclined angle relative to horizontal support 24.

Figure 11:
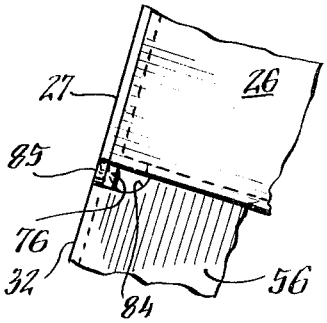
FIG. 11 is an enlarged detail view in side elevation of the area wherein the tilt platform is joined to the tray.

Lateral wings 36 and 38 are also folded 90 degrees about score lines 38 and 40, respectively, underneath tray bottom 30 to provide additional support for tray bottom 30 and maintain standard 32 in an upright condition. The notches 84 formed on the top edges of wings 34 and 36 can receive in frictional engagement one of the tongues 74, 76 extending downwardly from the bottom wall panel 30 to lock standard 32 and base 44 in its supporting position, as shown in FIGS. 10 and 11.

What is claimed as new is:

1. A display tray comprising:

a tray portion for supporting and displaying a plurality of articles including a front, rear, and a pair of opposed side walls, connecting said front and rear walls, each of said front, rear and side walls being foldably connected to a bottom wall for supporting said articles, a platform for supporting said tray portion at an inclined angle relative to a horizontal support surface, said platform including an upright standard panel hingedly coupled to the rear wall of said tray portion, a base hingedly coupled to said upright standard, said upright standard and base forming an included acute angle therebetween, and lateral support wings foldably connected to opposed edges of said upright standard extending inwardly beneath said bottom wall to support the same, each of said lateral support wings including a notch extending along the top edge thereof, and a tongue extends downwardly from the juncture of said back wall and bottom wall received in each of said notches.

2. The display tray of claim 1 wherein said rear wall panel includes a pair of panels foldably connected to each other and adhesively affixed to each other in back-to-back relation, and said upright standard is foldably connected to the lower edge of the outermost of said rear wall panels.

3. A unitary, paperboard blank for forming the display tray of claim 2.

4. The display tray of claim 1 wherein said front and rear panels include lateral panel extensions having a downwardly facing tab along its bottom edge thereof received within a notch formed in said bottom wall to lock said front, rear, sidewall and bottom walls together.

5. The display tray of claim 3 wherein each of said sidewalls includes a pair of mirror-image diagonal fold line extending from opposed, lower corners thereof to an intermediate point along said top edge thereof, and one of said laterally extending panels connected to said front and rear wall panels being adhesively connected to an area defined by each of said diagonal score lines and the remaining edges of said sidewall therebetween.

6. A unitary, paperboard blank for forming the display tray of claim 3.

7. A unitary, paperboard blank for forming the display tray of claim 4.

8. A unitary, paperboard blank for forming the display tray of claim 1.

* * * * *

UNITED STATES PATENT AND TRADEMARK OFFICE

CERTIFICATE OF CORRECTION

PATENT NO. : 4,331,231

DATED : May 25, 1982

INVENTOR(S) : Daniel J. Boyle

It is certified that error appears in the above—identified patent and that said Letters Patent is hereby corrected as shown below:

Col. 3, line 51 - delete "overly" (our mistake) and insert in lieu thereof -- overlie --.

Col. 3, line 66 - delete "overly" (our mistake) and insert in lieu thereof -- overlie --.

Col. 4, line 3 - delete "overly" (our mistake) and insert in lieu thereof -- overlie --.

Col. 4, line 8 - delete "overly" (our mistake) and insert in lieu thereof -- overlie --.

Signed and Sealed this

*Seventh* Day of *September 1982*

[SEAL]

*Attest:*

GERALD J. MOSSINGHOFF

*Attesting Officer*

*Commissioner of Patents and Trademarks*